United States Patent [19]

Ragland, Jr.

[11] Patent Number: 4,645,968

[45] Date of Patent: Feb. 24, 1987

[54] VIBRATION CONTROL OF COLOR PICTURE TUBE SHADOW MASK

[75] Inventor: Frank R. Ragland, Jr., Lancaster, Pa.

[73] Assignee: RCA Corporation, Princeton, N.J.

[21] Appl. No.: 867,618

[22] Filed: May 27, 1986

Related U.S. Application Data

[63] Continuation of Ser. No. 610,480, May 15, 1984, abandoned.

[51] Int. Cl.[4] ..... H01J 29/80

[52] U.S. Cl. ..... 313/407; 313/269

[58] Field of Search ..... 313/402, 404, 407, 269

[56] References Cited

U.S. PATENT DOCUMENTS 3,585,431 6/1971 Long ..... 313/85
3,772,555 11/1973 McKee et al. ..... 313/404
4,327,307 4/1982 Penird et al. ..... 313/407
4,437,036 3/1984 Ragland ..... 313/407

OTHER PUBLICATIONS

Sony Trinitron tube shadow masks use fine horizontal wires stretched across the apertured array to reduce vibration. (no enclosure).

*Primary Examiner*—Edward P. Westin
*Assistant Examiner*—William L. Oen
*Attorney, Agent, or Firm*—Eugene M. Whitacre; Dennis H. Irlbeck

[57] ABSTRACT

A color picture tube is improved by positioning shims on adjacent sides of a mask adjacent the mask corners and between the mask and its peripheral supporting frame. Because of the shims, the resonant frequency of the mask is raised.

4 Claims, 4 Drawing Figures

VIBRATION CONTROL OF COLOR PICTURE TUBE SHADOW MASK

This a continuation of application Ser. No. 610,480 filed May 15, 1984 now abandoned.

BACKGROUND OF THE INVENTION

This invention relates to color picture tubes of the type having a shadow mask attached to a peripheral frame, which is suspended in relation to a cathodoluminescent screen, and particularly to novel means for reducing microphonic vibrations in the shadow mask.

In these color picture tubes, the accuracy with which the electron beams, emitted from an electron gun, strike individual elemental cathodoluminescent screen areas depends, to a great degree, upon the accuracy with which the shadow mask apertures are aligned with the elemental screen areas during operation of the tube. Although vibration of the shadow mask relative to the elemental screen areas is generally undesirable, tube performance becomes greatly deteriorated when the frequency of mask vibration beats with the electron beam scanning frequency.

The present invention changes the resonant frequency of the mask to eliminate or greatly reduce any vibration beat with the scanning frequency.

SUMMARY OF THE INVENTION

A color picture tube is improved by positioning shims on adjacent sides of a mask adjacent the mask corners and between the mask and its peripheral supporting frame. Because of the shims, the resonant frequency of the mask is raised.

DETAILED DESCRIPTION

Figure 1:
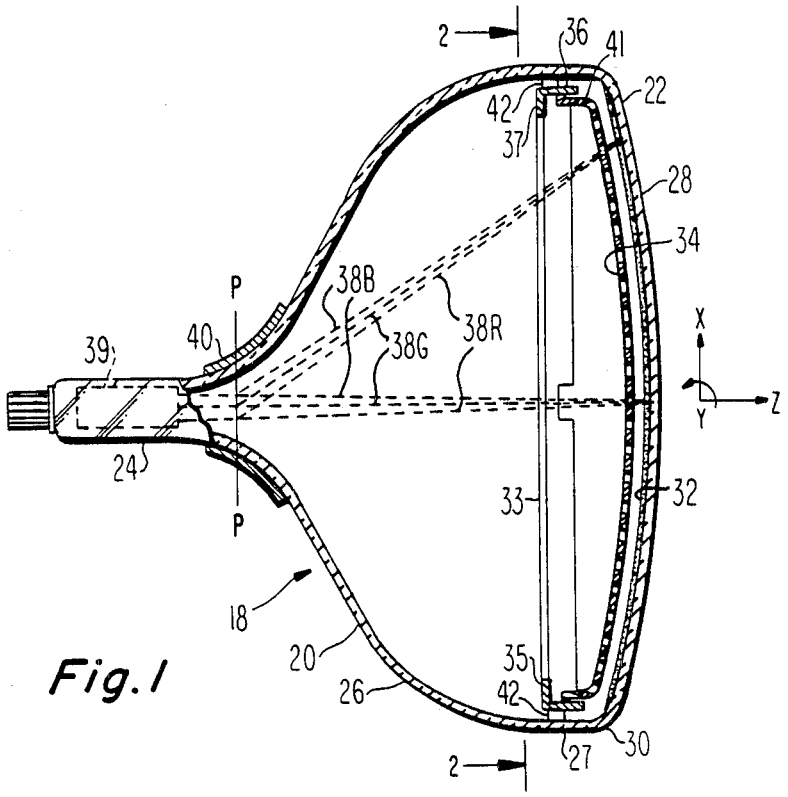
FIG. 1 is a plan view in axial section of an apertured mask cathode-ray tube.
Figure 2:
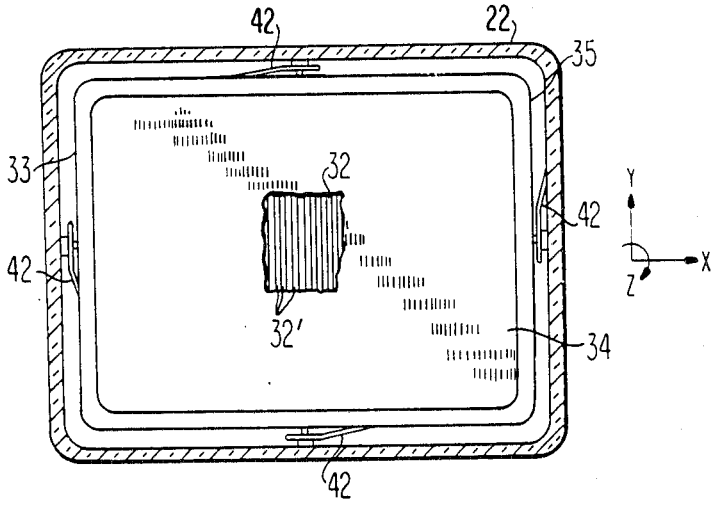
FIG. 2 is a back view of the faceplate and mask-frame assembly of the tube of FIG. 1.

FIGS. 1 and 2 illustrate a color picture tube 18 having an evacuated glass envelope 20 comprising a substantially rectangular faceplate panel 22 and a tubular neck 24 joined by a funnel 26. The faceplate panel includes two orthogonal axes; a major axis X—X, parallel to its wider dimension (usually horizontal), and a minor axis Y—Y, parallel to its narrower dimension (usually vertical). The major and minor axes are perpendicular to the central longitudinal axis Z—Z of the tube which passes through the center of the neck 24 and the center of the panel 22. The panel 22 comprises a viewing faceplate 28 and a peripheral flange or sidewall 30 which is sealed to the funnel 26 by a frit material 27. A three-color cathodoluminescent line screen 32 is located on the inner surface of the faceplate 28. The screen 32 comprises an array of phosphor lines 32' extending substantially parallel to a minor axis Y—Y of the tube. Portions of the screen 32 may be covered with a light absorbing material in a manner known in the art. A mask-frame assembly 33, comprising a substantially rectangular apertured color selection electrode or shadow mask 34 attached to a substantially rectangular peripheral frame 35 having an L-shaped cross-section, is removably mounted within the panel 22 in predetermined spaced relationship to the screen 32 by four springs 42. The mask 34 includes a multiplicity of slit-shaped apertures which are aligned in substantially parallel columns with web portions separating the slits within each column. The L-shaped frame 35 includes two flanges 36 and 37. The first flange 36 faces toward the screen 32 and approximately parallels the central longitudinal axis Z—Z. The second flange 37 extends inward toward and approximately perpendicular to the central longitudinal axis Z—Z. The mask 34 also includes a peripheral skirt 41 which is telescoped relative to the frame flange 36.

An inline electron gun 39 (illustrated schematically) is mounted within the neck 24 to generate and direct three electron beams 38B, 38R and 38G along coplanar convergent paths through the mask 34 to the screen 32.

The tube 18 is designed to be used with an external magnetic deflection yoke 40 surrounding the neck 24 and funnel 26 in the vicinity of their junction. When appropriate voltages are applied to the yoke 40, the three beams 38B, 38R and 38G are subjected to perpendicular magnetic fields that cause the beams to scan in a rectangular raster over the screen 32.

Figure 3:
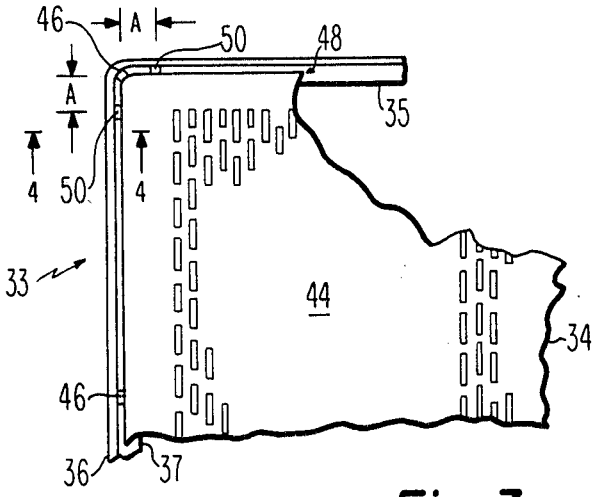
FIG. 3 is a partially broken-away plan view of a corner portion of the mask-frame assembly of FIG. 2.
Figure 4:
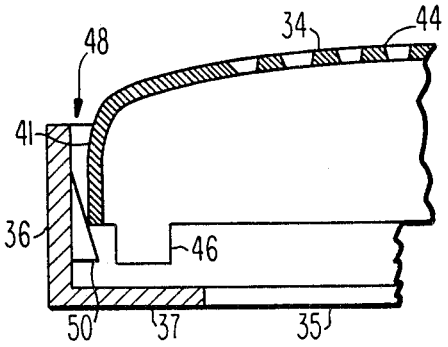
FIG. 4 is a sectional view of the corner portion of the mask-frame assembly taken at line 4—4 of FIG. 3.

FIGS. 3 and 4 show greater detail of the mask-frame assembly 33. The shadow mask 34 includes a central apertured portion 44 surrounded by the peripheral skirt 41. A plurality of tabs 46 extend from the distal edge of the skirt 41. At least one of the tabs 46 is located at each of the corners of the shadow mask 34. The tabs 46 are welded to the first flange 36 of the frame 35. The outer dimensions of the skirt 41 are less than the corresponding inner dimensions of the first flange 36, whereby a gap 48 is formed between the skirt 41 and the first flange 36. A plurality of wedge-shaped shims 50 are located in the gap 48 between and in contact with the skirt 41 and the first flange 36. Two of the shims 50 are positioned on opposite sides of each tab 46 at the corners of the shadow mask 34. The shims 50 are welded to the frame 35.

In a color picture tube having a 68.58 cm (27 inch) diagonal screen and which did not utilize the shims described herein, it was found that areas of the shadow mask near the mask corners have a mechanical resonance of approximately 115 Hertz. Such vibration frequency causes an objectionable visible beating with the electron beam deflection frequency. The Z axis motion of the mask is accompanied by a motion of the mask skirt in the X-Y plane. Specifically, as the mask moves up, the skirt moves in. By placing a shim between the skirt and frame on each side of each corner at a spacing A, as shown in FIG. 3, where A equals 38.1 mm (1.5 inch), the resonant frequency of the mask was raised to 145 Hertz. Such raising of resonant frequency eliminates or greatly reduces the aforementioned objectionable visible beating.

Although heretofore, the shims have been described as separate elements being located between the frame and mask, the scope of the present invention also covers several variations of shim means that produce the same rise in resonant frequency. In one of these variations, bent-in tabs are provided, instead of the shims, on the frame flange 36 which contact the mask skirt 41 at the same locations as the shims, shown in the drawings. In another variation, there are outwardly extending flutes on the mask skirt 41 which contact the frame flange 36 at the same locations as the shims, shown in the drawings.

What is claimed is:

1. In a color picture tube including an evacutated envelope having a substantially rectangular faceplate panel with major and minor axes and wherein a central longitudinal axis of said tube passes through the center of said faceplate perpendicular to the major and minor axes, said faceplate panel including a substantially rectangular shadow mask welded at various points to a substantially rectangular peripheral frame mounted within said envelope, said frame having a flange approximately paralleling the central longitudinal axis, the improvement comprising shims being laterally positioned along the periphery of said frame between mask-to-frame weld points on adjacent sides of said mask adjacent each corner and being located between said mask and said flange, and said shims being attached only to said frame, whereby the resonant frequency of said mask is raised.

2. In a color picture tube including an evacuated envelope having a substantially rectangular faceplate panel with major and minor axes and wherein a central longitudinal axis of said tube passes through the center of said faceplate perpendicular to the major and minor axes, said faceplate panel including a substantially rectangular shawdow mask, said shadow mask having a peripheral skirt welded at various points including its corners to a substantially rectangular peripheral frame mounted within said envelope, said frame including a flange approximately paralleling the central longitudinal axis, the improvement comprising the outer dimensions of the skirt of said shadow mask being less than the corresponding inner dimensions of said flange whereby a gap exists between said skirt and said flange, and a plurality of shims located between and in contact with said mask and said flange and laterally positioned along the periphery of said frame between mask-to-frame weld points, and said shims being attached only to said frame, whereby the resonant frequency of said mask is raised.

3. In a color picture tube including an evacuated envelope having a substantially rectangular faceplate panel with major and minor axes and wherein a central longitudinal axis of said tube passes through the center of said faceplate perpendicular to the major and minor axes, said faceplate panel including a substantially rectangular shadow mask, said shadow mask having a peripheral skirt welded at various points including its corners to a substantially rectangular peripheral frame mounted within said envelope, said frame including a flange approximately paralleling the central longitudinal axis, the improvement comprising the outer dimensions of the skirt of said shadow mask being less than the corresponding inner dimensions of said flange, said shadow mask including a plurality of tabs extending from the distal edge of said skirt, at least one of said tabs being located at each of the corners of said shadow mask, said tabs being welded to said flange, and a plurality of shims located between and in contact with said skirt and said flange, at least two of said shims being positioned on opposite sides of a tab at a corner of said mask, said shims being attached only to said frame.

4. In a color picture tube including an evacuated envelope having a substantially rectangular faceplate panel with major and minor axes and wherein a central longitudinal axis of said tube passes through the center of said faceplate perpendicular to the major and minor axes, said faceplate panel including a substantially rectangular shadow mask welding at various points to a substantially rectangular peripheral frame mounted within said envelope, said frame having a flange approximately paralleling the central longitudinal axis, and said mask having a peripheral skirt approximately paralleling said flange, the improvement comprising shim means being laterally positioned along the periphery of said frame between mask-to-frame weld points on adjacent sides of said mask adjacent each corner and being located between said mask skirt and said flange, said shim means being an integral part of said frame touching the mask skirt at other than weld points, whereby the resonant frequency of said mask is raised.

* * * * *